United States Patent [19]

Bruggisser et al.

[11] 3,934,831

[45] Jan. 27, 1976

[54] TRAVERSING THREAD GUIDE

[75] Inventors: Klaus Bruggisser; Felix Graf, both of Winterthur; Albert Ruegg, Pfaffikon, all of Switzerland

[73] Assignee: Rieter Machine Works Ltd., Winterthur, Switzerland

[22] Filed: Dec. 10, 1973

[21] Appl. No.: 423,501

[30] Foreign Application Priority Data

Dec. 11, 1972 Sweden ..... 17959/72

[52] U.S. Cl. ..... 242/43; 242/157 R; 242/158.3; 242/158.5

[51] Int. Cl.[2] ..... B65H 54/30

[58] Field of Search..... 242/43, 158.3, 158.5, 157 R

[56] References Cited

UNITED STATES PATENTS

| | | | |
|---|---|---|---|
| 2,934,284 | 4/1960 | Steeger | 242/158.3 |
| 3,059,874 | 10/1962 | Hays | 242/158.5 |
| 3,086,722 | 4/1963 | Altice et al. | 242/43 |
| 3,373,949 | 3/1968 | Swallow | 242/43 |
| 3,407,262 | 10/1968 | Snyder, Jr. | 242/43 X |
| 3,527,423 | 9/1970 | Burow | 242/43 |
| 3,664,596 | 5/1972 | Lenk | 242/43 |

FOREIGN PATENTS OR APPLICATIONS

| | | | |
|---|---|---|---|
| 23,784 | 9/1962 | Germany | 242/158.3 |

*Primary Examiner*—Stanley N. Gilreath
*Attorney, Agent, or Firm*—Werner W. Kleeman

[57] ABSTRACT

A traversing thread guide for winding a thread, comprising an elongated cam engaging portion which meshes with a helically extending endless cam groove of a traverse cylinder. A gliding member for linear to-and-fro guiding of the traversing thread guide along a rigid guide device extends parallel to the rotational axis of the traverse cylinder, said guiding member being arranged offset with respect to the center of the cam engaging portion. A thread guide member is rigidly arranged on the gliding member. The cam engaging portion comprises a base for inner radial guidance of the traversing thread guide, said base being provided with a curvature which at least approximates the curvature of the cam groove base or bottom and comprises an upper surface designed for outer radial guidance of the thread guide on an inside surface of the extended guide device. The gliding member which is rigidly connected with the cam engaging portion is provided with at least one gliding section for contacting a guide edge of the extended guide device, and which gliding section encloses an angle with the upper surface of the cam engaging portion.

18 Claims, 6 Drawing Figures

Fig. 1
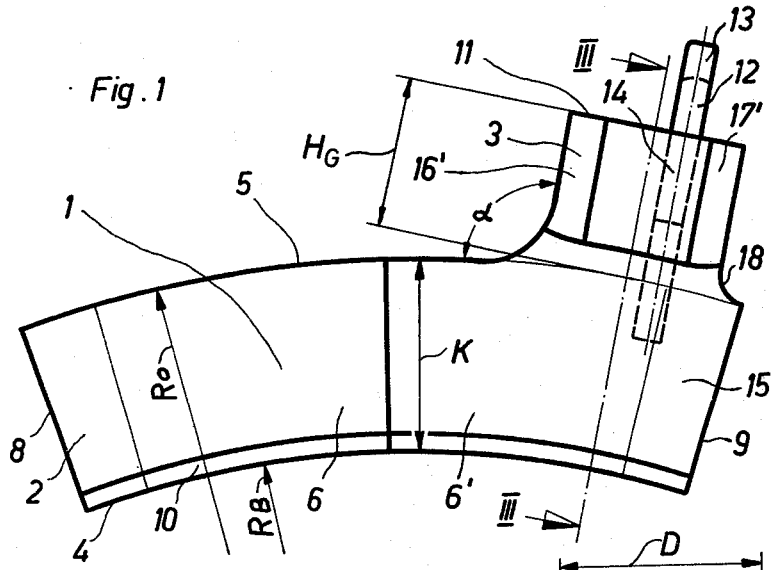
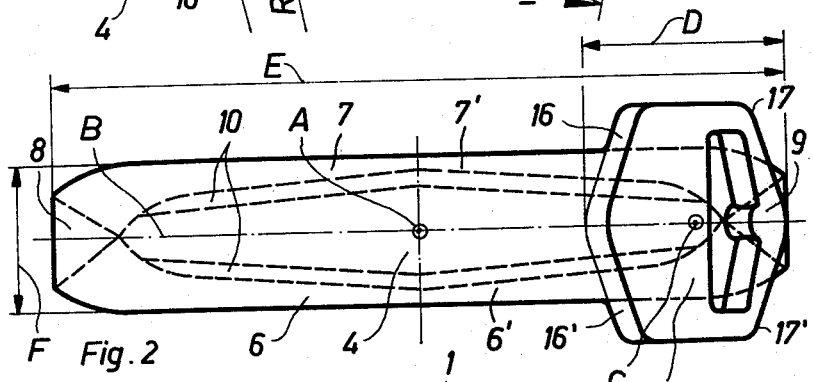
Fig. 2
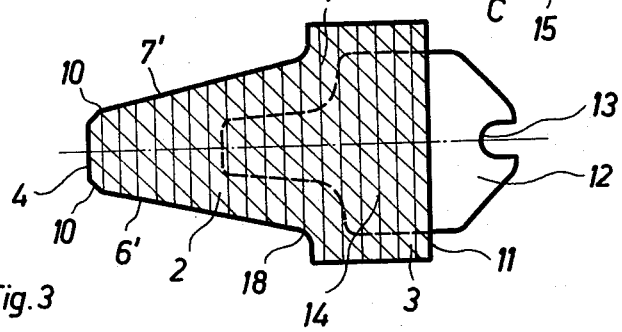
Fig. 3

TRAVERSING THREAD GUIDE

BACKGROUND OF THE INVENTION

The present invention concerns a traversing thread guide for winding a thread comprising an elongated cam engaging portion engaging or meshing with an endless helical cam groove of a traverse cylinder, a gliding member connected to the cam engaging portion for guiding the traversing thread guide linearly along an extended guide element and a thread guide member or portion rigidly connected to the gliding member.

A traversing thread guide of the above mentioned type is already known for winding a thread on cross-winders or cross-winding machines, and comprises an elongated cam engaging portion meshing with an endless cam groove extending helically on the outer surface of a traverse cylinder and which groove crosses itself. The gliding member of this traversing thread guide is rotatably connected with the cam engaging portion via a pin rotatably arranged in the gliding member. This pin is offset from the center of the cam engaging portion and is arranged on one end thereof in such manner that the longitudinal axis of the pin extends outside the rotational axis of the traverse cylinder when the cam engaging portion is placed into the cam groove. The gliding member can be supported by guide rims or ledges in correspondingly fitting recesses in parallel arranged guide rails and can be linearly traversed to-and-fro parallel to the rotational axis of the traverse cylinder. On the gliding member a thread guide element is arranged offset with respect to the longitudinal axis of the pin, the thread guide element being designed as an extended guide loop angled away from the gliding member and exceeding the length of the gliding member with its longer part. Owing to the offset arrangement of the gliding member on the pin, the thread guide element can move relative to the center of the cam engaging portion at the reversal points of the linear to-and-fro traversing movement such that a prolonged stop of the thread guide element at the reversal points is avoided, at which reversal points the center of the cam engaging portion temporarily stops.

The common support and linear guiding element for the gliding member however requires expensive manufacturing processes to insure for parallelism of the guide rims and the guide rails as well as of the recesses provided therein, and in which arrangement the parallel guiding action should not be impaired by wear of the material caused by the to-and-fro traversing movement. The rotatable connection between the gliding member and the cam engaging portion is an additional element of the traversing thread guide subject to wear. Thus, the individual guide elements of this type of traversing thread guide not only must be manufactured precisely, but also necessitate a massive and wear resistant design of the cam engaging portion. A traversing thread guide of such complicated design comprising a plurality of wear points, however, is subject to rapid wear by the traversing movement, i.e. it is economically disadvantageous and e.g. unsuitable for high speed applications.

Traversing thread guides are also known to the art wherein a gliding member thereof is guided on the inside surface of a cover- and guide-rail facing a traverse cylinder. On the gliding member there is arranged an extended guide loop, extending in a direction opposite to the direction of rotation of the traversing cylinder away from the gliding member. Since the thread guide member is thus offset from the center of the gliding shoe in such arrangement, as in the arrangement mentioned above, prolonged stopping of the thread guide member at the reversal points is avoided. Traversing thread guides of this type, however, have not proven to be satisfactory, since the gliding member for stability reasons and due to the long extension of the guide loop or bracket must be designed to be massive and wear resistant and contacts the guide rail with a large surface. Due to the massive design the center of gravity of such a traversing thread guide is located within the gliding member which thus is subject to increased wear, something which is disadvantageous at high speeds of the to-and-fro traversing movement.

Also known to the art is the guiding of a traversing thread guide with a cam engaging portion between the bottom of a cam groove and the inside surface of a tube surrounding the traverse cylinder, and which tube is provided with a slot for linearly guiding the gliding member. Together with the guide element for the gliding member this arrangement presents a large number of guide surfaces causing rapid wear of the traversing thread guide, particularly at high operating speeds. Furthermore, guiding the cam engaging portion on both sides in the recesses requires additional manufacturing operations on the inside surface of the tube and necessitates a design of the tube which permits pivoting of a part of the tube to be opened for exchanging the traversing thread guide. A further disadvantage is seen in that due to the arrangement of the thread guide member at the center of the traversing thread guide, the thread guide member is stopped temporarily at the reversal points, which proves disadvantageous for uniform winding.

SUMMARY OF THE INVENTION

Thus, it is a primary object of the present invention to eliminate the disadvantages of the traversing thread guides heretofore known in the art and to provide a traversing thread guide for winding a thread incorporating a gliding member having a thread guide member and which gliding member is arranged offset with respect to the center of the cam engaging portion, and wherein the traversing thread guide can be guided without excessive wear and without necessitating expensive manufacturing of guide devices for guiding it. Another object of this invention is to provide a traversing thread guide for winding thread wherein the center of gravity of the thread guide is located in the cam engaging portion to reduce the tilting moment acting on the gliding member during the to-and-fro traversing movement of the thread guide.

The traversing thread guide for winding a thread according to the invention comprises an elongated cam engaging portion for engaging or meshing with a helically extending endless cam groove of a traverse cylinder, a gliding member for linear to-and-fro guiding of the traversing thread guide along a rigid extended guide device extending substantially parallel to the rotational axis of the traverse cylinder. The gliding member is arranged offset with respect to the center of the cam engaging portion, and a thread guide member is rigidly arranged on the gliding member. According to the invention the cam engaging portion comprises a base for inner radial guidance of the traversing thread guide, which base is provided with a curvature which at least approximates the curvature of the groove bottom of the helical cam groove. The cam engaging portion further comprises an upper surface designed for outer radial guidance of the traversing thread guide on an inside surface of the extended guide device. The gliding member which is rigidly connected with the cam engaging portion is provided with at least one gliding section for contacting a guide edge of the extended guide device, and which gliding section encloses an angle with the upper surface of the cam engaging portion.

The cam engaging portion and the gliding member can be made from synthetic material and can be made in one piece, i.e. formed integral. The length of the cam engaging portion preferably corresponds to several times its width. Thus, there can be achieved the result, e.g. that the cam engaging portion sufficiently overlaps crossing points of the helical cam groove and guides the traversing thread guide at such points without disturbances. The curvature of the base of the cam engaging portion, e.g. approximates the curvature radius or radius of curvature of the cam groove bottom. The upper surface of the cam engaging portion for guidance on a curved inside surface, or also on a flat inside surface, can be designed curved. For outer radial guidance, however, the upper surface of the cam engaging portion also can be chosen flat or straight, such that it can be guided on a straight inside surface of the extended guide device. The base and the upper surface of the cam engaging portion preferably form the guiding surfaces for guiding the traversing thread guide in radial direction with respect to the traversing cylinder axis. The gliding member preferably designed exclusively for linearly guiding the traversing thread guide thus can be designed with dimensions, particularly with a height and/or a mass, which is several times smaller than the corresponding dimensions of the cam engaging portion. By so designing the gliding member, the overall center of gravity of the traversing thread guide advantageously can be located more closely to the center of gravity of the cam engaging portion, thus reducing the tilting moment acting on the gliding member at the reversal points of the to-and-fro traversing movement and caused by the sudden deceleration of the linear movement of the traversing thread guide.

In one embodiment of the invention the center of the gliding member can be, e.g. offset with respect to the center of the upper surface of the cam engaging portion on the longitudinal axis extending through the center. The gliding member can be arranged on one end portion of the cam engaging portion, e.g. within an outer quarter of the length of the cam engaging portion. The gliding section can form an angle of, e.g. 90° with the upper surface of the cam engaging portion or any other angle needed for contacting the correspondingly designed guide edge. According to another embodiment the gliding member can be provided with a plurality of gliding sections. The gliding member can be of cylindrical form or rhomboid-shaped.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a side view of a traversing thread guide;

FIG. 2 is a top plan view of the traversing thread guide depicted in FIG. 1;

FIG. 3 is a cross-sectional view of the traversing thread guide taken substantially along the line III—III of FIG. 1;

DETAILED DESCRIPTION OF THE PREFERRED EMBODIMENTS

Figure 4:
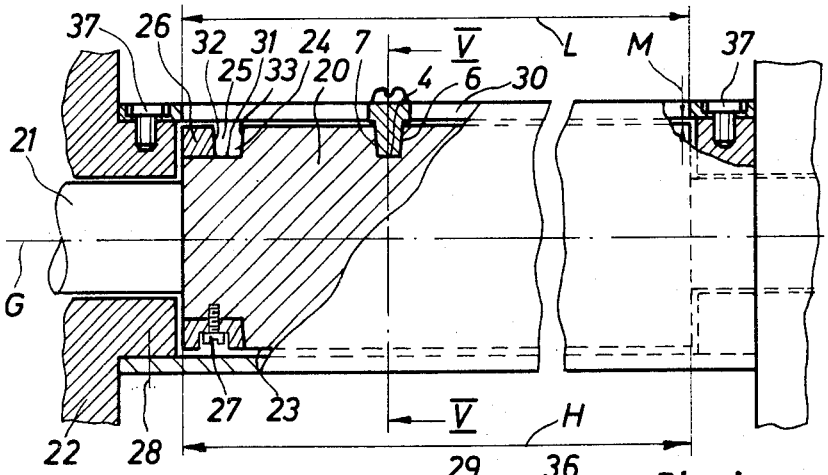
FIG. 4 is a partial cross-section, taken substantially along the line IV—IV of FIG. 5 of a traverse cylinder.

Describing now the drawings, in FIGS. 1 through 3 there is shown a traversing thread guide 1 with a cam engaging portion 2 and a gliding member 3, the cam engaging portion 2 possessing a length E corresponding to several times the width F of the cam engaging portion 2. The cam engaging portion 2 contains a curved base 4 with a curvature radius $R_B$ and an upper surface 5, curved in the same direction, with a curvature radius $R_O$ which is larger than the curvature radius $R_B$. As shown particularly well in FIGS. 2 and 3, the cam engaging portion 2 contains side surfaces 6, 6′ and 7, 7′ which are increasingly inclined towards each other in the direction towards the base 4 as well as towards the face sides or end faces 8 and 9. The side surfaces 6, 7 furthermore merge via bevelled edges 10 into the base 4. In this manner the profile or outer contour of the cam engaging portion 2 can be adapted to a cam groove helically extending on a traverse cylinder (not shown in FIGS. 1 and 2) and can engage without disturbances, e.g. without jamming, with the cam groove and can be guided therein radially with respect to the traverse cylinder axis.

The gliding member 3 is arranged on the cam engaging portion 2 so as to be offset with respect to the center A of the upper surface 5, i.e. arranged outside of the center A on the longitudinal axis B extending on the upper surface 5 through such center A. The gliding member 3 is rigidly connected with the cam engaging portion 2 and together they form one piece. On the upper surface 11 of the gliding member 3 there is arranged a thread guide member or portion 12 provided with a thread guide slot or recess 13, the thread guide member 12 being inserted, as shown in FIG. 3, with a mounting extension or portion 14 in the gliding member 3 and rigidly connected thereto. The thread guide member 12, which can be fabricated from ceramic material, is arranged offset with respect to the center C of the upper surface 11 towards the end 15 of the cam engaging portion 2, as veiwed in the longitudinal direction of the cam engaging portion 2, for reasons to be described later on. As best seen by referring to FIGS. 1 and 2 the gliding member 3 with its center C is arranged at the end 15 within a length range or distance D of the length E of the cam engaging portion 2, this length range D corresponding for instance to one-quarter of the length E. Gliding member 3 is of substantially rhomboid shape having mutually facing pairs of surfaces 16, 16′ and 17, 17′ forming the rhomboid and enclosing an angle of 90° with the upper surface 5 of the cam engaging portion 2. Each of these surfaces 16, 16′, 17 and 17′ can constitute a gliding section contacting a straight guide device on which it is traversed to-and-fro. The gliding member 3 has a height $H_G$. Although the gliding member 3 is shown on an enlarged scale in FIGS. 1 to 3 for clarity, its actual dimensions and thus also its height H are preferably chosen several times smaller than the corresponding dimensions of the cam engaging portion 2, and specifically in such a manner that the overall center of gravity of the traversing thread guide 1 is located more closely to the center of gravity of the cam engaging portion 2. At the reversal points of the to-and-fro movement of the traversing thread guide 1 in a cam groove of a traverse cylinder (not shown in FIGS. 1 and 2) a brief but high load can act upon the connection of the gliding member 3 and the cam engaging portion 2, this load being caused by the sudden deceleration of the movement. For this reason the gliding member 3 and the cam engaging portion 2 merge via a rounded edge or transition location 18, which increases the stability of the connection between the gliding member 3 and the cam engaging portion 2.

Figure 5:
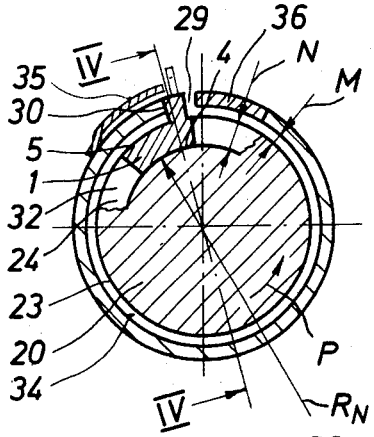
FIG. 5 is a cross-sectional view of the traverse cylinder taken substantially along the line V—V of FIG. 4.

In FIGS. 4 and 5, in which the parts shown identically in FIGS. 1 through 3 are generally indicated with the same reference numerals, there is shown a traverse cylinder or barrel cam 20, a shaft 21 of which is supported on both sides in a frame 22. The shaft 21 is connected with a suitable drive mechanism (not shown) which rotates this shaft about its longitudinal axis G. On the jacket or outer surface 23 of the traverse cylinder 20 there is provided an endless helically extending cam groove 24 which crosses over itself (not shown) and contains reversal points 25. The traverse cylinder 20 is provided with end pieces 26 (shown at one end only) detachably mounted on the traverse cylinder 20 by a suitable connecting element 27 e.g. screws or the like. In this way the reversal points 25 of the cam groove 24 of the traverse cylinder 20 which are subject to considerable wear, and at which points there changes the helix or guide angle and thus the direction in which the cam groove 24 extends, can be exchanged. The traverse cyclinder 20 is surrounded by a tube 28 mounted on the frame 22. Tube 28 extends over and past the length H of the traverse cylinder 20 and is provided with a slot 29 of a length L. The slot 29 extends parallel to the rotational axis G and serves as an extended rigid guide device with a guiding edge 30 for the gliding member 3 as will be described more fully hereinafter. Between the outer surface or jacket 23 and the tube 28 there only prevails a small clearance M. The traversing thread guide 1 is placed into the cam groove 24, the groove bottom or base 31 of which has a curvature radius $R_N$. The cam engaging portion 2 engaging or meshing with the cam groove 24 contacts with its base 4 the cam groove bottom 31 of the cam groove 24 since its curvature radius $R_B$ corresponds to the curvature radius $R_N$. The cam engaging portion 2 preferably contacts the groove side walls 32 and 33 only with a minimum upper portion of the side walls 6, 7' and 6', 7 of the cam engaging portion 2 in such a manner that at the other regions a small clearance can be maintained between the side walls 6, 7', 6', 7 and the cam groove walls 32, 33. The height K of the cam engaging portion 2 (FIG. 1) approximately corresponds to a depth N of the cam groove 24. The gliding member 3 protrudes into the slot 29, and as the traverse cylinder 20 rotates in a direction as indicated by the arrow P, can contact the guiding edge 30 with the gliding section 16 or 16' according to the helix angle of the cam groove 24.

As the traverse cylinder 20 rotates, the traversing thread guide 1, guided radially or concentrically with the traverse cylinder 20 respectively, by the groove bottom 31, traverses to-and-fro along the guiding edge 30 which is contacted by the gliding member 3, owing to the reversing cam groove 24, and thus is guided axially or linearly respectively. At the reversal points 25 the traversing thread guide 1 is pivoted about its center A in such a manner that either the gliding section 16 or the gliding section 16' contacts the guiding edge 30. The offset thread guide member 12 is simultaneously pivoted, while the center A of the traversing thread guide 1 i.e. the center A at the reversal points 25 respectively is at a standstill. The center, i.e. the center point of the thread guide slot 13 thus can move along a path at the reversal points 25 which approximates a desired path of movement, the reversal of the thread guide slot 13 at the reversal points 25 being effected with a greater acceleration.

As the elongated cam engaging portion 2 is arranged inside the tube 28 and as its curved upper surface 5 is guided on the confronting inside wall or surface 34 of the tube 28 spaced therefrom at the small distance M, the traversing thread guide 1 is prevented from being lifted out of the cam groove. The traversing thread guide 1 thus is merely guided between the cam groove base or bottom 31 and the cylindrical inside surface 34 with a small clearance and concentrically with respect to the traverse cylinder 20.

For preventing the leakage of for instance oil, impurities or other contaminants from the tube 28 a cover plate 35 is mounted on the outside of the tube 28. This cover plate 35 extends over the upper surface 11 of the gliding member 3 and partially covers the same. It is for this reason that the thread guide member 12 is arranged in offset relationship with respect to the center C. For exchanging the traversing thread guide 1 a portion 36 of the tube 28 is detachably mounted with screws 37 or equivalent fastening expedients at the frame 22.

In the exemplary illustrated embodiment the gliding member 3, with respect to the direction of rotation P, leads or precedes the tangential movement of the traversing thread guide 1. The traversing thread guide 1, however, also can be placed into the cam groove 24 with its cam engaging portion 2 arranged beneath the tube part 36, the direction of rotation P being the same, and the gliding sections 17, 17' can be used for linear guidance. In this case the gliding member 3 and thus the thread guide member 12 are trailing with respect to the direction of rotation P and thus trail the tangential movement of the traversing thread guide 1.

Figure 6:
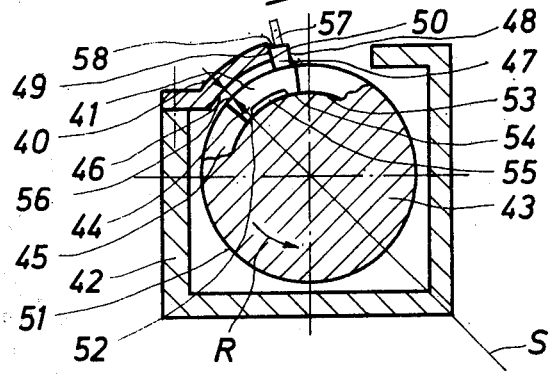
FIG. 6 is a cross-sectional view of a modified construction of traverse cylinder.

According to the embodiment of FIG. 6 it is possible to use, instead of the tube 28 shown in FIGS. 4 and 5, a guide rail 40 as a guiding device for the linear to-and-fro traversing movement of a traversing thread guide 41, the guide rail 40 being mounted on a frame 42 which supports a traverse cylinder 43. The traverse cylinder 43 is again connected with a suitable drive mechanism (not shown) rotating the traverse cylinder 43 in the direction indicated by the arrow R. The traversing thread guide 41 is placed with its cam engaging portion 44 into a cam groove 45 extending helically on the traverse cylinder 43. On the cam engaging portion 44 a gliding member 47 is arranged in offset relationship with respect to the center (not here particulary referenced) of the upper surface 46, and which gliding member 47 is of cylindrical shape. A portion of the cylinder jacket or outer surface 48 serving as a gliding section 50 of the gliding member 47 contacts a guiding edge 49 of the guide rail 40 during such time as the traverse cylinder 43 rotates, and thus this gliding section 50 is traversed to-and-fro linearly. A base 52 of the cam engaging portion 44 is curved at its ends according to the base or bottom 53 of the cam groove 45 and in its middle portion is provided with a recess 55 of more pronounced curvature. In this manner there are formed at the ends of the base 52 protrusions or feet 54 contacting the cam groove base 53 and radially guiding the cam engaging portion 44. The rail 40 is provided with a curved inside surface 56 facing the traverse cylinder 43 and arranged at a small distance S from the jacket or outer surface 51. The distance S prevents lifting-off of the cam engaging portion 44 from the cam groove 45 and the curved upper surface 46 of the cam engaging portion 44 is guided by the inside surface 56. The traversing thread guide 41 in this arrangement is also concentrically guided with a small clearance with respect to the traverse cylinder 43 only between the cam groove base or bottom 53 and the cylindrical inside wall 56 of the guiding or guide device 40. A thread guide member 57 is arranged at the center of the upper surface 58 of the gliding member 47 and thus also in this arrangement is arranged in offset relationship with respect to the center of the cam engaging portion 44.

THe design and function of the individual components or elements of this embodiment otherwise correspond to those described with reference to the embodiments illustrated in FIGS. 1 to 5. The constructional embodiment of the traversing thread guide according to FIG. 6, however, permits easy exchange of the traversing thread guide without first having to open-up the arrangement by detaching parts.

It is an advantage of the inventive traversing thread guide that the concentric guidance thereof with respect to the traverse cylinder is merely effected by the cam engaging portion, i.e. on its base and on its upper surface. Thus, there is achieved the result that the gliding member only needs one gliding section for guiding a linear to-and-fro traversing movement. A further advantage resulting therefrom resides in the fact that the dimensions and/or the mass of the gliding member can be kept considerably smaller compared to the dimensions of the cam engaging portion. The resulting location of the overall center of gravity of the traversing thread guide in the direction towards the center of gravity of the cam engaging portion achieves a lower location of the center of gravity and thus of the weight of the traversing thread guide in the cam groove. The location of the center of gravity lower into the cam groove not only proves advantageous insofar as the tilting moment at the reversal points is reduced, but also insures a quiet and uniform movement of the traversing thread guide in the cam groove as the danger of the traversing thread guide being lifted-off from the cam groove during operation is reduced if not entirely eliminated. The inventive traversing thread guide is preferably provided with simply designed guiding surfaces and in such a manner that there can be dispensed with the manufacture of expensive guiding devices for the traversing thread guide. Thus, high economic feasibility is achieved with the inventive traversing thread guide. The traversing thread guide of this development can be used at high operating speeds, e.g. for winding a thread on draw-winding machines, as well as at low operating speeds for winding a thread.

While there is shown and described present preferred embodiments of the invention, it is to be distinctly understood that the invention is not limited thereto, but may be otherwise variously embodied and practiced within the scope of the following claims.

What is claimed is:

1. A traversing thread guide for winding a thread and adapted to engage with a helically extending endless cam groove of a traverse cylinder, said cam groove having a bottom, said traversing thread guide comprising an elongated cam engaging portion, a gliding member for linear to-and-fro guiding of the traversing thread guide along a rigid guide device extending substantially parallel to the rotational axis of the traverse cylinder, said gliding member being arranged in offset relationship with respect to the center of the cam engaging portion, a thread guide member rigidly arranged on the gliding member, the center of gravity of the traversing thread guide being located in the cam engaging portion, said cam engaging portion comprising a base for the inner radial guidance of the traversing thread guide, said base possessing a curvature which at least approximates the curvature of the cam groove bottom, said base being in contacting relation with said cam groove bottom, said cam engaging portion further comprising an upper surface servicing for the outer radial guidance of the traveling thread guide on an inside surface of the guide device, said thread guide being freely radially movable with respect to the traverse cylinder between said inside surface of the guide device and the bottom of said cam groove, said gliding member being rigidly connected with the cam engaging portion and being provided with at least one gliding section for contacting a guide edge of the guide device, said gliding section enclosing an angle with the upper surface of the cam engaging portion.

2. The traversing thread guide as defined in claim 1, wherein the base of the cam engaging portion is curved with a curvature radius essentially corresponding to the curvature radius of the cam groove base.

3. The traversing thread guide as defined in claim 2, wherein the base of the cam engaging portion is provided with a recess at its central region and at its ends is curved with said curvature radius of the base of the cam engaging portion.

4. The traversing thread guide as defined in claim 1, wherein the upper surface of the cam engaging portion for guiding at a curved inside surface of the guide device is curved in the same direction.

5. The traversing thread guide as defined in claim 1, wherein the upper surface of the cam engaging portion and the inside surface of the guide device are substantially straight.

6. The traversing thread guide as defined in claim 1, wherein the height of the cam engaging portion substantially corresponds to the depth of the cam groove.

7. The traversing thread guide as defined in claim 1, wherein the gliding member is arranged outside the center of the upper surface of the cam engaging portion on a longitudinal axis extending through the center of the upper surface.

8. The traversing thread guide as defined in claim 1, wherein the gliding member is arranged on the upper surface of the cam engaging portion within a predetermined length range of the length of the cam engaging portion, said predetermined length range being about one-quarter of said length of the cam engaging portion.

9. The traversing thread guide as defined in claim 1, wherein at least the length of the gliding member is smaller than the length of the cam engaging portion.

10. The traversing thread guide as defined in claim 1, wherein at least the mass of the gliding member is smaller than the mass of the cam engaging portion.

11. The traversing thread guide as defined in claim 1, wherein both the length and the mass of the gliding member are smaller than the length and mass of the cam engaging portion.

12. The traversing thread guide as defined in claim 1, wherein the gliding member is of substantially rhomboid shape and is provided with two gliding sections for contacting the guide edge.

13. The traversing thread guide as defined in claim 1, wherein the gliding member is of substantially cylindrical shape.

14. The traversing thread guide as defined in claim 1, wherein a rounded connection zone is provided between the gliding member and the cam engaging portion.

15. The traversing thread guide as defined in claim 1, wherein the cam engaging portion and the gliding member are integrally connected with one another.

16. The combination with a rotatable traverse cylinder possessing a substantially helically extending endless cam groove having a curved bottom and a guide device having a guide edge and extending substantially parallel to the axis of rotation of the rotatable traverse cylinder, of a traversing thread guide for winding a thread, said traversing thread guide engaging with the helically extending endless cam groove of the rotatable traverse cylinder, said traversing thread guide comprising a cam engaging portion, a gliding member for the substantially linear to-and-fro guiding of the traversing thread guide along the guide device, said gliding member being arranged in offset relationship with respect to the center of the cam engaging portion, a thread guide member carried by said gliding member, the center of gravity of the traversing thread guide being located in the cam engaging portion, said cam engaging portion comprising a base for the inner radial guidance of the traversing thread guide, said base possessing a curvature which at least approximates the curvature of the cam groove bottom, said base being in contacting relation with said cam groove bottom, said cam engaging portion further comprising an upper surface serving for the outer radial guidance of the traversing thread guide on an inside surface of the guide device, said thread guide being radially unrestrained with respect to the traverse cylinder between said inside surface of the guide device and the bottom of said cam groove, said gliding member being rigidly connected with the cam engaging portion, said gliding member further being provided with at least one gliding section for contacting said guide edge of the guide device, said gliding member enclosing an angle with the upper surface of the cam engaging portion.

17. The traversing thread guide as defined in claim 1, wherein only one of said at least one gliding sections contact said guide device during linear to-and-fro guiding of the traversing thread guide.

18. The traversing thread guide as defined in claim 1, wherein said gliding member has a dimension as viewed in the longitudinal direction of said cam engaging portion and a mass which are several times smaller than the corresponding longitudinal dimension and mass of the cam engaging portion.

* * * * *

UNITED STATES PATENT OFFICE

CERTIFICATE OF CORRECTION

PATENT NO. : 3,934,831

DATED : January 27, 1976

INVENTOR(S) : Klaus Bruggisser, Felix Graf and Albert Ruegg

It is certified that error appears in the above-identified patent and that said Letters Patent are hereby corrected as shown below:

Page 1, left-hand column, in paragraph [30] read "Sweden" as --Switzerland--

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*